United States Patent [19]

Hujimori et al.

[11] 4,002,037

[45] Jan. 11, 1977

[54] SELF-ADVANCING SUPPORT FOR USE IN THE PIT OF COAL OR METAL MINE

[75] Inventors: Masao Hujimori; Shigeo Nakajima; Ken Takahashi, all of Tokyo; Tsunetoshi Ito; Toshio Shimada, both of Yokohama; Hajime Endo, Kushiro; Nobuo Kiyama, Yokohama, all of Japan

[73] Assignee: Taiiheiyo Engineering Incorporated, Tokyo, Japan

[22] Filed: Mar. 3, 1976

[21] Appl. No.: 663,190

[30] Foreign Application Priority Data

Aug. 8, 1975 Japan ..... 50-97057

[52] U.S. Cl. ..... 61/45 D; 248/357

[51] Int. Cl.[2] ..... E21D 15/44

[58] Field of Search ..... 61/45 D, 63; 299/33, 299/31; 173/23; 248/357; 91/170 MP

[56] References Cited

UNITED STATES PATENTS

| | | | |
|---|---|---|---|
| 2,752,757 | 7/1956 | Joy | 61/45 D |
| 3,693,729 | 9/1972 | Blurton et al. | 173/23 |
| 3,898,845 | 8/1975 | Plevak et al. | 61/45 D |

FOREIGN PATENTS OR APPLICATIONS

| | | | |
|---|---|---|---|
| 1,201,288 | 9/1965 | Germany | 61/45 D |

*Primary Examiner*—Dennis L. Taylor
*Attorney, Agent, or Firm*—Frank J. Jordan

[57] ABSTRACT

A self-advancing support for use in the pit of coal or metal mine designed to support the pit roof after the mining operation by a shearer and having a mechanism for enabling the self-advancing support to be moved without using such means as a truck and a lift, said mechanism being housed within the self-advancing support and/or detached therefrom.

4 Claims, 8 Drawing Figures

SELF-ADVANCING SUPPORT FOR USE IN THE PIT OF COAL OR METAL MINE

The present invention relates to a self-advancing support for use in the pit of a coal or metal mine and, more particularly, to a self-advancing support having a mechanism for enabling the self-advancing support to be moved, the mechanism comprising wheels which are used only when the self-advancing support is moving.

The conventional self-advancing support for use in the pit of a coal or metal mine is used, for example, in combination with the shearer at the time of the mining operation in the pit face and serves to prevent the pit roof from crumbling down after the mining operation. Therefore, the conventional self-advancing support comprises a table, beams mounted on the table for supporting the pit roof, iron poles for supporting these beams, a shifter for enabling the support to be moved in the pit, arch frames and hydraulic cylinders or the like, so that the weight of the self-advancing support reaches a substantial value, which has made it difficult to attach such means as wheels to the table thereof.

Accordingly, the conventional supports have been used by mounting them on a truck using a lifting device such as a crane and a winch, carrying them to the pit face in the pit and bringing them down from the truck onto the pit floor using the lifting device. This has made it necessary to bring the lifting device to the pit face where the support is to be brought down from the truck, to provide an ample space in the pit necessary for rendering the lifting device operative, and to keep the height of the pit a little higher than the sum of the heights of the truck and of the support. Therefore, the carriage of the conventional supports has required a lot of time and labor thus lowering the efficiency of the mining operation substantially.

The present invention is intended to eliminate the above-mentioned drawbacks.

Accordingly, an object of the present invention is to provide a self-advancing support for use in the pit of a coal or metal mine which is capable of being easily carried in the pit and being freely used at the pit face.

Another object of the present invention is to provide a self-advancing support for use in the pit of a coal or metal mine which is capable of being carried either on rails or on the pit floor.

Figure 1:
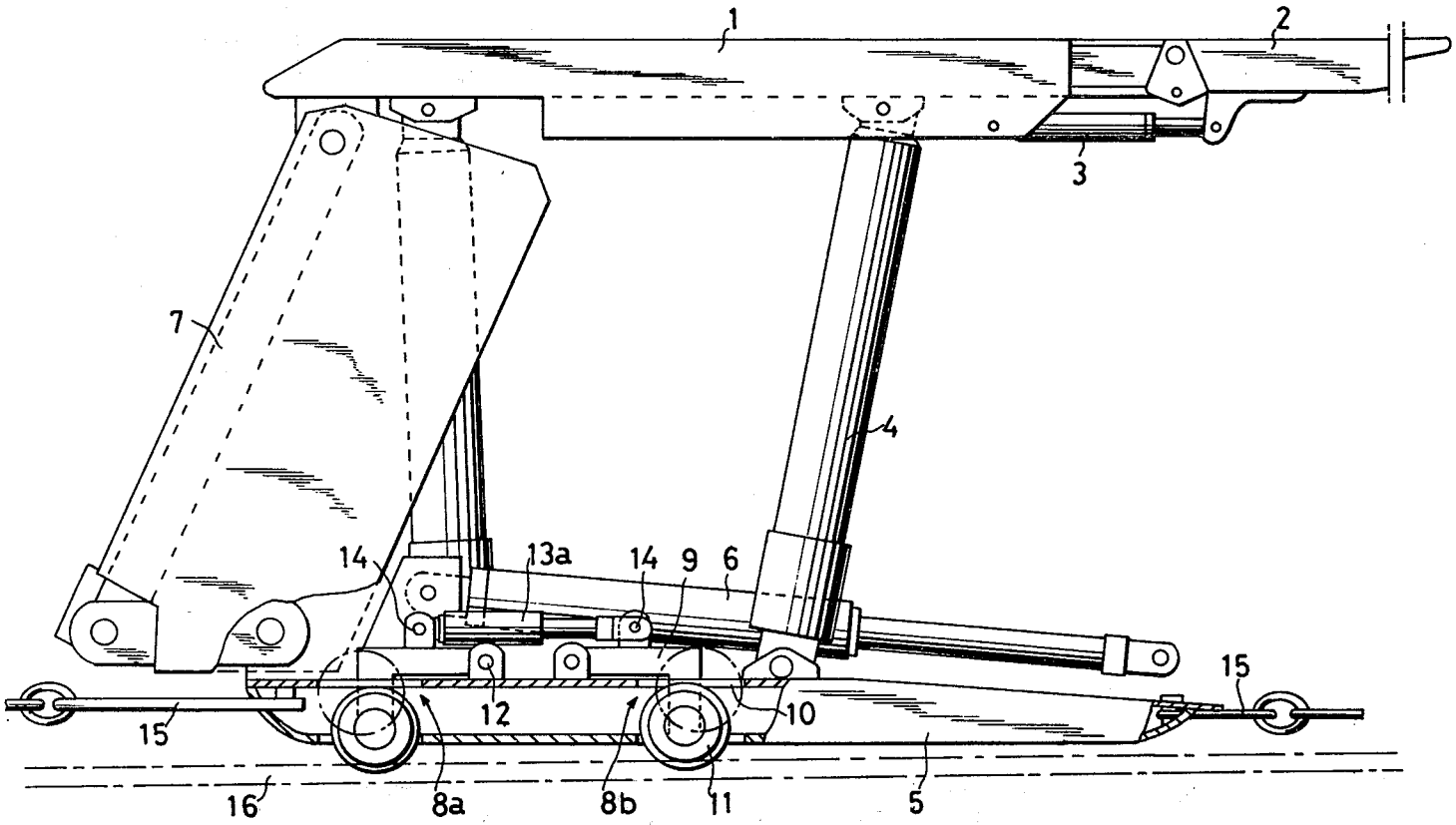
FIG. 1 is a side view, partly broken away, showing a self-advancing support according to the present invention.
Figure 2:
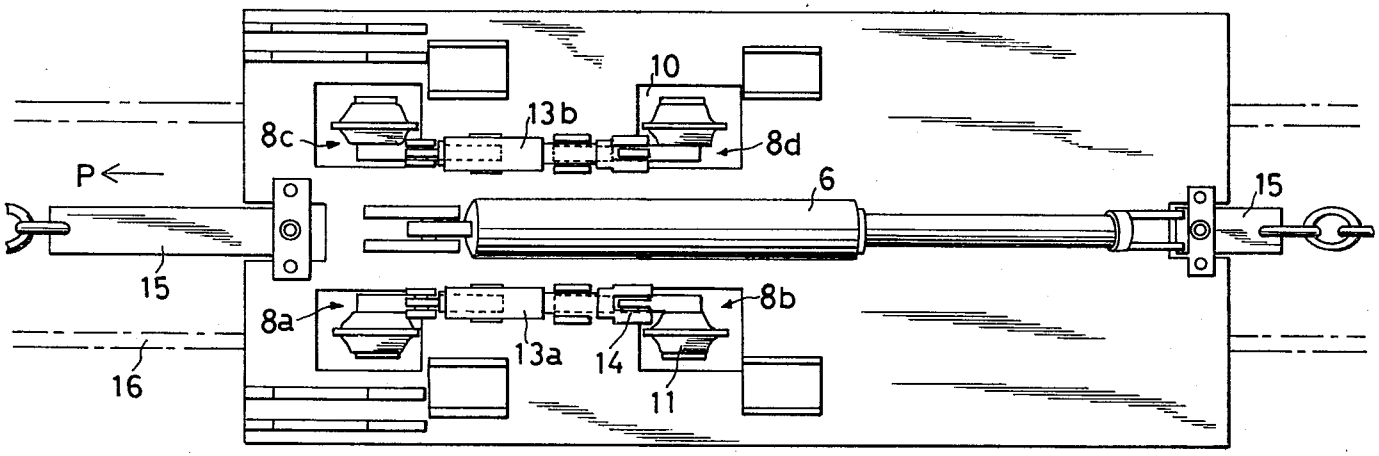
FIG. 2 is a plan view showing the table of the self-advancing support.
Figure 3:
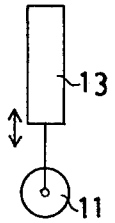
FIGS. 3 through 8 show some examples of a mechanism for enabling the self-advancing support to be carried.
Figure 4:
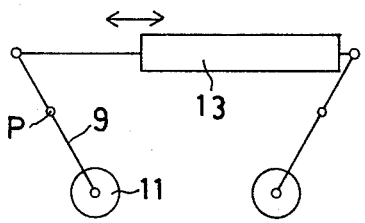
Figure 5:
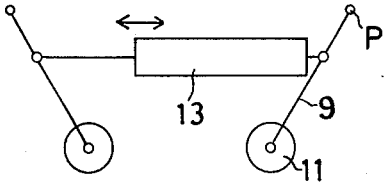
Figure 6:
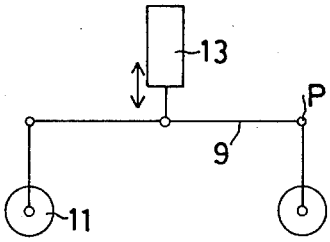
Figure 7:
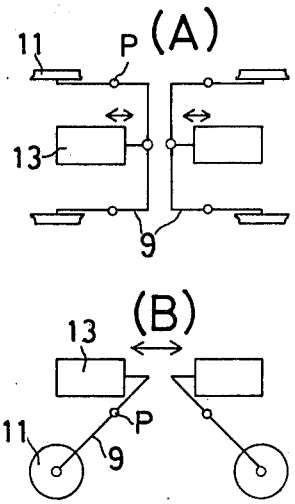
Figure 8:
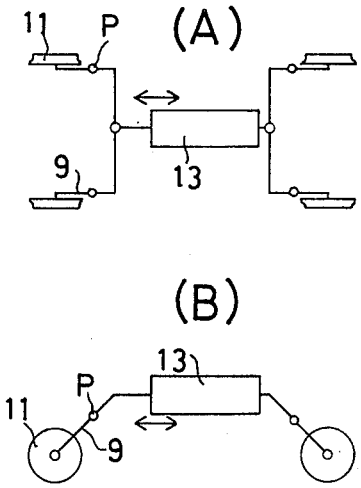

There will be now described an embodiment of the present invention referring to FIGS. 1 and 2.

In these Figures, numeral 1 represents a center beam, 2 an end beam freely rotatably attached to the front end of the center beam, 3 a hydraulic cylinder piston rod assembly for rotating the end beam, 4 four iron poles for supporting the center beam 1, 5 a table onto which the respective bottom ends of the iron poles are fixed, and 8*a*, 8*b*, 8*c* and 8*d* four wheel mechanisms of the present invention each comprising a respective wheel 11 attached to the front end of each arm 9 for retraction into a hole 10 the other end of each arm 9 being attached to the table 5 by means of a detachable pin 12. The four wheel mechanisms 8*a*, 8*b*, 8*c* and 8*d* thus constructed are respectively located at four positions on the table 5 in such a manner that a pair of the wheel mechanisms 8*a* and 8*b* are parallel to a direction P, in which the table is drawn, and symmetrical to the other pair of the wheel mechanisms 8*c* and 8*d*.

The pair of the wheel mechanisms 8*a* and 8*b* are arranged to alternatively extend and house their respective wheels 11 by the operation of a hydraulic cylinder piston rod assembly 13*a* while the other pair of the wheel mechanisms 8*c* and 8*d* are arranged to alternatively extend and house their respective wheels 11 by the operation of a hydraulic cylinder piston rod assembly 13*b*. Namely, the arms are attached to both ends of the respective hydraulic cylinder-piston rod assemblies 13*a* and 13*b* by means of pins 14.

Further, in the Figures numeral 15 represents coupling members arranged at the front and back ends of the table 5 and numeral 16 denotes rails arranged on the pit floor.

For carrying the self-advancing support, the hydraulic cylinder-piston assemblies 13*a* and 13*b* are operated to extend the respective piston rods thereof. As a result, each arm 9 is rotated downwardly with the pin 12 serving as the center of rotation and the wheel 11 attached to the distal end of the arm is extended below the table 5 through the hole 10. After the wheels 11 are brought into contact with the rails 16, the hydraulic cylinder-piston rod assemblies 13*a* and 13*b* are further operated to lift the self-advancing support. At this stage the operation of the hydraulic cylinder-piston rod assemblies 13*a* and 13*b* is stopped leaving four wheels 11 mounted on the rails 16. Therefore, the self-advancing support can be easily drawn on the rails 16 by means of the coupling member 15 to a desired pit face in the pit. When the self-advancing support reaches the pit face, the hydraulic cylinder-piston rod assemblies 13*a* and 13*b* are reversely operated to draw in the respective piston rods so that each arm 9 is rotated upwardly to house the wheel 11 in the table 5, thus leaving the self-advancing support ready for use at the pit face.

The present invention allows a plurality of the self-advancing supports connected to one another through the coupling members 15 to be carried at one time.

Another embodiment of the present invention, in which the wheels 11 comprise tire-wheels, allows the self-advancing support to be carried on the pit floor to the desired pit face, thus eliminating the necessity of arranging rails on the pit floor. In this case, too, the self-advancing support is used at the pit face with the wheels housed in the table or with the wheels, including the wheel mechanisms and the cylinder detached from the self-advancing support.

According to the present invention a hydraulic cylinder-piston rod assembly may be attached to each of the wheel mechanisms. Namely, the front end of the piston rod of each cylinder, the other end of which is fixed to the table, may be attached to each of the arms.

It goes without saying that according to the present invention the number of the wheels 11 is not limited to four, that is, may be more or less than four.

FIGS. 3 through 9 show some examples of the wheel mechanisms but the present invention is not limited to them. In these Figures numeral 9 represents an arm, 11 a wheel and 13 a hydraulic cylinder-piston rod assembly. The piston rod of the hydraulic cylinder-piston rod assembly 13 is extended or retracted in a direction as shown by an arrow and the arm 9 is rotated with a point P serving as a center of its rotation to shift the wheel 11 in the upper or lower direction. It is preferable that these wheel mechanisms comprising the hydraulic cylinder-piston rod assemblies the arms, the wheels or the like be detachable from the self-advancing support for a number of reasons. One reason is that the wheel mechanisms are liable to be damaged due to the weight added to the self-advancing support from the pit roof at the time when the self-advancing support is actually used at the pit face. Another reason is that the wheel mechanisms which become unnecessary at the time of using the self-advancing support at the pit face can be used to carry a different self-advancing support. Since the wheel mechanisms of the present invention are used only at the time of carrying the self-advancing support, it may be provided that they can be easily detached from the self-advancing support at any time except when the latter is carried.

According to the present invention, the wheels arranged to be housed in the table of the self-advancing support can be extended from the table at the time of carrying the self-advancing support, thus permitting the support to be drawn and easily moved. Therefore, this eliminates the necessity of preparing the lifting device which has been conventionally required to lift the support in the pit, providing the space in which the lifting device can be operated, and making the pit higher sufficiently to let the lifting device and the support pass through. The present invention allows the self-advancing support to be easily and freely carried in the pit with the pit being only sufficiently high to let the support pass through. Further, the wheels may be tire-wheels which can run on the pit floor or metal wheels which are arranged to run on the rails. Therefore, the carriage of the self-advancing support can be attained both on the pit floor and on rails. Furthermore, the wheels can be housed in the table or detached therefrom, without hindering the operation of the self-advancing support. If a means for driving the wheels is mounted on the table, the self-advancing support will be driven.

What is claimed is:

1. A self-advancing support for use in the pit of a coal or metal mine comprising a table, at least one beam mounted on the table for supporting the pit roof, poles supporting the beam on the table, a shifter for enabling the support to be moved in the pit, a plurality of wheel assemblies, each of said wheel assemblies comprising an arm, means pivotally connecting one end of each of said arms to the table, a respective wheel rotatably mounted on the other end of each of said arms, hydraulic cylinder-piston rod assemblies connected to said arms for pivoting said arms thereby alternatively to pivot said arms sufficiently downwardly for the wheels to support the table whereby the support may be transported with the aid of the wheels and to pivot said arms sufficiently upwardly for the table to rest directly on the floor of the pit whereby the wheels are not caused to bear a load when the support is in operation at a pit face, and openings in the table for receiving said wheels when the table is resting directly on the floor of the pit.

2. A self-advancing support according to claim 1, further comprising means pivotally connecting the distal end of the cylinder of each hydraulic cylinder-piston rod assembly to one of said arms and means pivotally connecting the distal end of the piston rod of the same hydraulic cylinder-piston rod assembly to another of said arms, whereby operation of the thusly connected hydraulic cylinder-piston rod assembly simultaneously pivots two of said arms thereby simultaneously to lower or raise two of said wheels.

3. A self-advancing support according to claim 1, in which said wheels are metal for running on rails laid on the pit floor.

4. A self-advancing support according to claim 1, in which tires are mounted on said wheels for running directly on the pit floor.

* * * * *